US005265782A

United States Patent [19]

McNamara

[11] Patent Number: 5,265,782

[45] Date of Patent: Nov. 30, 1993

[54] MILITARY MEDICAL VEST

[76] Inventor: Daniel T. McNamara, Ret. 5, Box 94A, Carthage, N.C. 28327

[21] Appl. No.: 875,401

[22] Filed: Apr. 29, 1992

[51] Int. Cl.[5] ..... A45F 3/02

[52] U.S. Cl. ..... 224/204; 224/209; 2/108; 2/94

[58] Field of Search ..... 2/102, 247, 250, DIG. 7, 2/108, 94; 224/204, 201, 202, 203, 205, 206, 209; 128/201.25, 201.27, 202.11, 202.19; 206/803

[56] References Cited

U.S. PATENT DOCUMENTS

| | | | |
|---|---|---|---|
| 2,506,685 | 5/1950 | Sadloski et al. | 224/201 |
| 2,678,447 | 5/1954 | Bracken | 2/94 |
| 2,760,699 | 8/1956 | Rivers-MacPherson | 224/201 |
| 4,087,864 | 5/1978 | LaBove et al. | 2/102 |
| 4,106,121 | 8/1978 | Belson | 2/102 |
| 4,169,550 | 10/1979 | Williams | 206/803 |
| 4,328,532 | 5/1983 | Paredes | 2/102 |
| 4,609,084 | 9/1986 | Thomas | 224/259 |
| 4,637,075 | 1/1987 | Ingrisano et al. | 2/102 |
| 4,876,724 | 10/1987 | Suzuki | 2/94 |
| 5,111,981 | 5/1992 | Allen | 224/202 |

*Primary Examiner*—Henry J. Recla
*Assistant Examiner*—David J. Walczak
*Attorney, Agent, or Firm*—Rhodes Coats and Bennett

[57] ABSTRACT

The present invention entails a military medical vest having a pair of front panels, a pair of side panels and a back panel. Secured to the back panel is a series of elongated transversely extending IV bag holder compartments. Disposed above the IV bag holder compartments is a series of field dressing compartments. Also located on the back panel and positioned above the field dressing compartments is a plurality of individual chest tube holders. Secured to the side and front panels of the vest are a series of compartments for holding various supplies and paraphernalia typically used by a military medic.

7 Claims, 3 Drawing Sheets

MILITARY MEDICAL VEST

FIELD OF INVENTION

The present invention relates to carriers for medical supplies and more particularly to a military vest adapted to receive and support various medical supplies such as IV packages, etc.

BACKGROUND OF THE INVENTION

Medical military personnel have the unique military and medical task of treating seriously wounded patients for extended periods of time with limited medical supplies and equipment. Soldiers injured in combat may not have the opportunity to be quickly transferred to a medical facility or hospital. Instead, a military medic may have to provide extended medical care to a seriously injured soldier in the field of combat.

To provide effective medical assistance, essential medical supplies must be readily available to the military medics for treating the patient. Because of the combat conditions under which the military medics must be able to treat patients, access to medical supplies is limited. There are certain medical supplies that should always be available to military medics, even in the severest of combat conditions. Such indispensable medical supplies include chest tubes, field dressings, IV containers, IV catheters, eye kits, surgical kits, sterile bandages, tape, and IV bags. A plurality of many of the above supplies need to be carried by the military medic due to the high likelihood of the need to treat a multiple of injuries. Without a plurality of such indispensable medical supplies, the ability of the military medic to treat patients would be unacceptably limited.

To ensure that the above described indispensable medical supplies are available to the military medic at all times, the supplies must be personally carried by the military medic. Military medics must have the ability to manually carry and travel with the medical supplies over rugged terrain. In addition, efficient access to the medical supplies should be available. The capability of the military medic to effectively carry and access this equipment in a combat environment is a determining factor on the medic's ability to treat injured soldiers. In order for the military medic to carry and have proper access to indispensable medical supplies, the medic must be provided with appropriate gear to carry the medical supplies.

The conventional method of the military medic for carrying supplies is by hand-carrying a medical bag containing the medical supplies. There are numerous disadvantages and problems with the military medic's current practice of carrying medical supplies in medical bags. In fact, the problems of using medical bags was accentuated in the recent Desert Shield and Desert Storm conflicts. Medical bags which carried essential medical supplies were cumbersome, bulky, and very difficult to carry in the harsh terrain of the Middle East. One reason that the medical bags were unnecessarily difficult to carry was that the weight of the medical supplies was concentrated and would not be uniformly distributed on the carrier's body. Another reason for the difficulty in traveling with the hand-carried medical bag was that the carrier's hands were unnecessarily occupied.

Because the medical bags were hand carried, there was also the potential problem of medical personnel becoming unintentionally separated from the medical bags and the enclosed medical supplies. For instance, during incoming rounds of enemy fire there was the potential that military medics would become separated from their medical bags. Unfortunately, because of enemy fire and other combat conditions, the possibility of military medics becoming separated from essential medical supplies was unnecessarily high.

Another problem with the prior art medical bags used in the Desert Shield and Desert Storm conflicts was that medical equipment could not be orderly located within the medical bag. When a particular medical supply was needed, the medic had to search throughout the bag to locate the desired medical supply. In limited visibility conditions, such as at night, valuable life-threatening time can be wasted searching for the desired medical supply.

The use of a medical bag to hold medical supplies can also result in problems in keeping the medical bags stocked with all the essential medical supplies. Because supplies in the bag are not positioned in a fixed location that is easily visible, there is the real potential that the absence of a piece of equipment belonging in the medical bag may be overlooked. Such an inventory related mistake could result in the unnecessary loss of life.

The prior art does disclose a vest designed to carry some types of equipment For instance, U.S. Pat. No. 4,106,121, issued Aug. 15, 1978; and U.S. Pat. No. 3,529,307, issued Sep. 22, 1970; disclose tactical load bearing vests for carrying general military equipment such as canteens. In addition, U.S. Pat. No. 4,637,075, issued Jan. 20, 1987, discloses a vest designed to carry civilian medical supplies. No medical vest is shown in the prior art which is capable of handling the specific medical supplies and other equipment that is required in combat or similar adverse conditions.

SUMMARY AND OBJECTS OF THE INVENTION

The present invention is a medical military vest worn by military medics. Military medics wear the vest over the standard-issued flak jacket to provide a load bearing vest for carrying essential medical supplies and military equipment. Deficiencies in prior art medical vests are overcome by the present invention.

The present invention medical military vest includes a plurality of compartments and holders specifically designed for carrying medical and military supplies necessary in a combat environment. Attached to the medical military vest is a plurality of chest tube holders, IV bag compartments, and other compartments and holders which are uniformly located about the vest. The vest is capable of individually compartmentizing or individually securing a plurality of both chest tubes and IV bags. The vest's ability to carry a plurality of both chest tubes and IV bags is essential for the military medic. Prior art civilian medical vests which are used under different conditions are inadequate for use in combat situations.

The medical military vest, in addition, includes compartments and holders for field dressings, IV catheters, a roll of tape, a D-ring, a flashlight, a strobe light, and a side arm holster. The compartments and holders are uniformly located about the vest to provide a load bearing vest which disperses the weight of the equipment about the medic's body. The fixed locations of the medical or military supplies on the vest enable a medic to memorize the location of each medical supply and to quickly and effectively access the supplies' position, even in limited visibility. In addition, medical supply evaluation and inventory is made more certain by having individualized compartments and holders for each essential medical supply carried by the vest.

Therefore, it is an object of the present invention to provide a load-bearing vest for carrying essential medical supplies in a combat environment or other adverse environment.

Another object of the present invention is to provide a vest capable of carrying military equipment.

Another object of the present invention is to provide a medical military vest that is adaptable to fit over a standard flak jacket worn by a military soldier.

Another object of the present invention is to provide a vest for carrying medical and military supplies at fixed positions on the vest so that the wearer, through memorization of the location of the supplies on the vest, can access the supplies quickly and in limited visibility.

Another object of the present invention is to provide a plurality of IV bag compartments having laterally opposing openings to give the vest wearer access to the IV bags with either the right or left hand.

Another object of the present invention is to provide a medical military vest designed to operate in combat conditions, and more specifically, a medical military vest that is waterproof and buoyant so as to act as a life jacket.

Another object of the present invention is to provide a load bearing vest that evenly distributes the weight of supplies carried by the vest about the wearer's body.

Another object of the present invention is to provide a medical military vest that is camouflaged.

Another object of the present invention is to provide a vest that is capable of carrying a combination of military equipment and medical gear.

Another object of the present invention is to provide a medical military vest capable of carrying chest tube at a location on the vest that leaves the arms of the vest wearer unobstructed.

Other objects and advantages of the present invention will become apparent and obvious from a study of the following description and the accompanying drawings which are merely illustrative of such invention.

DETAILED DESCRIPTION OF THE INVENTION

Figure 1:
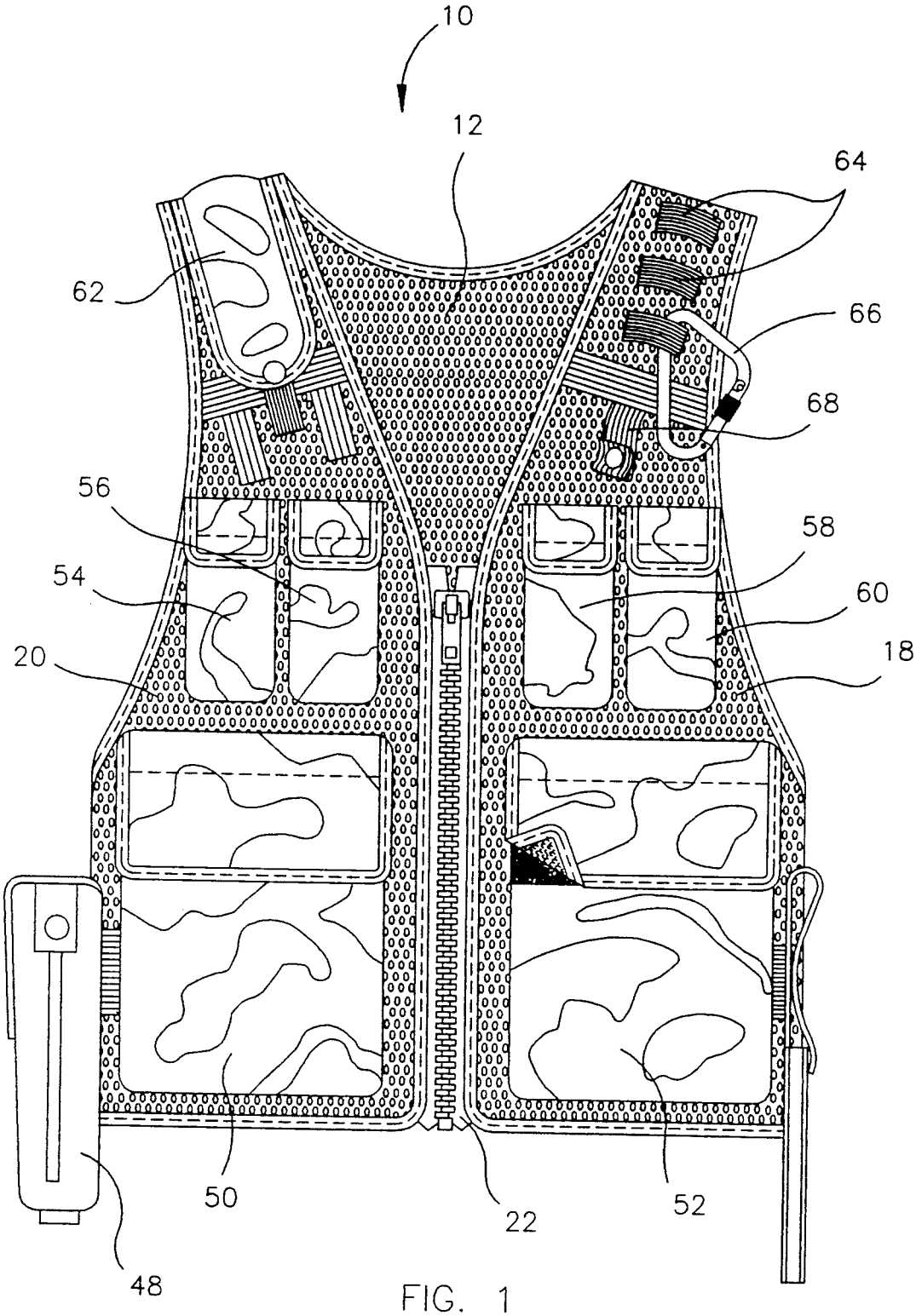
FIG. 1 is a front elevational view of the military medical vest of the present invention.
Figure 2:
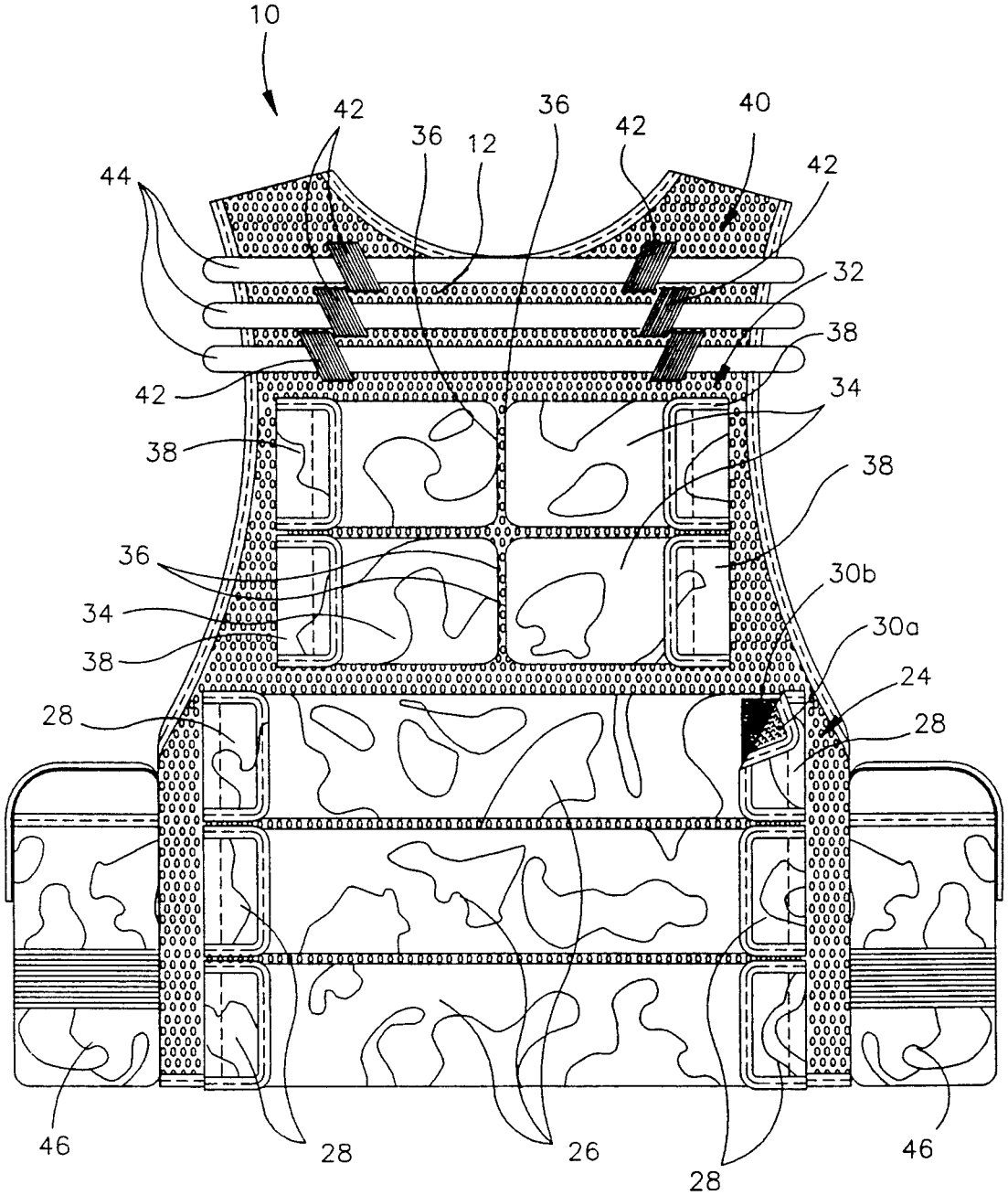
FIG. 2 is a rear elevational view of the military medical vest of the present invention.
Figure 3:
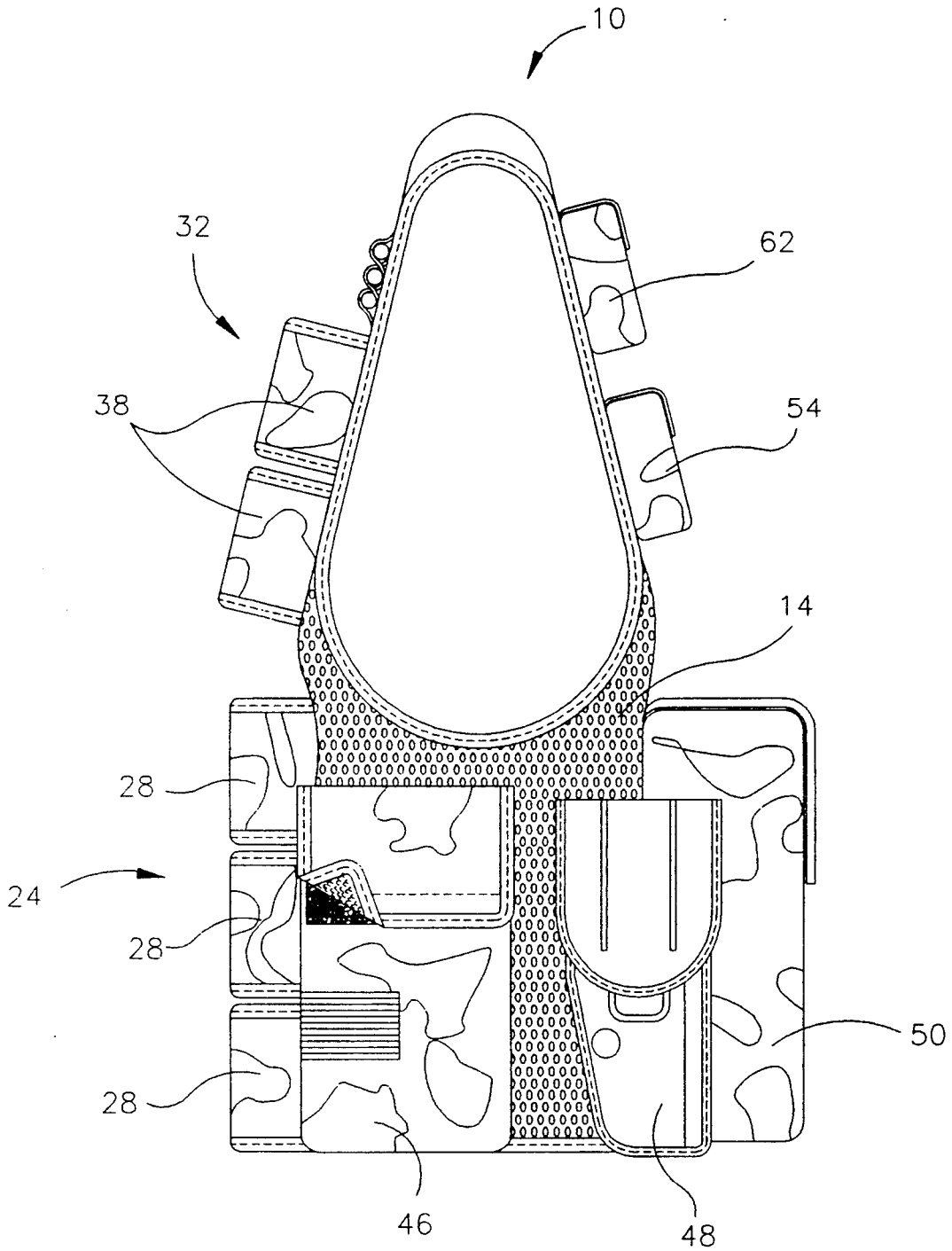
FIG. 3 is a side elevational view of the military medical vest of the present invention.

With further reference to the drawings, the military medical vest of the present invention is shown therein and indicated generally by the numeral 10. Vest 10 includes a back panel 12 that is joined with a pair of side panels 14 which are in turn joined with a pair of divided front panels 18 and 20. A zipper assembly 22 connects front panels 18 and 20.

As seen in the drawings, vest 10 forms a pair of side arm openings as well as a neck and head opening. The military medical vest 10 just described can be constructed and made of various suitable materials such as nylon, etc. It will be appreciated however that the overall quality and durability of the vest 10 is rugged and durable.

As noted above, the present vest 10 is a medical vest that is particularly suited for military use. In that regard, vest 10 is specifically designed to carry a wide range and an adequate quantity of various medical supplies. Turning one's attention to back panel 12 of the military medical vest 10, it is seen that the same includes a series of IV bag holders indicated generally by the numeral 24. In particular, IV bag holders 24 includes a series of elongated IV bag compartments 26. Each IV bag compartment 26 includes a pair of open ends which are defined about opposite ends of an open channel that is formed completely through the IV bag compartment 26. Secured about each open end of each IV bag compartment 26 is an end flap 28 that is designed to either close the IV bag compartment 26 or to leave the same open such that an IV package or container can be placed into the compartment or removed from the compartment. To secure each end flap to a respective IV bag compartment 26, a pair of mating Velcro® strips **30*a* and 30*b* are provided on selected portions of the end flap 28 and adjacent areas of the IV bag compartment 26. These Velcro® strips 30*a* and 30*b* enable the end flap 28 to be tightly secured about the end openings of each IV bag compartment 26**.

Continuing to refer to the rear panel 12 of the military medical vest 10, it is seen that above the IV bag holders 24 there is provided a series of field dressing compartments indicated generally by the numeral 32. In the case of the embodiment disclosed herein, there are four individual field dressing compartments with each individual compartment being referred to by the reference numeral 34. As seen in the drawings, each individual compartment 34 includes an inner closed end 36 while the opposed end or the outside end is open. Secured adjacent each open end of the individual compartments 34 is a flap 38. As was the case with the IV bag holders 24, the individual compartments 34 and the flaps 38 are provided with conventional hook and loop fasteners (Velcro®) that enable the flaps 38 to be positioned in a closed position or an open position.

Also formed about back panel 12 just above the field dressing compartments 32 is a chest tube holding structure indicated generally by the numeral 40. As can be seen in the drawing, the chest tube holder 40 includes a series of loops 42 with the individual loops being paired together where two horizontally spaced loops cooperate to secure a chest tube indicated by the numeral 44.

Now referring to the side panels 14 of the military medical vest 10, it is seen that the same includes a series of IV catheter holders indicated by the numeral 46. Disposed about one side panel is a gun holster 48 that is designed to accept and support a gun which would be typically issued to a military person in combat operations.

Turning to the front of the vest and particularly to front panels 18 and 20, about the lower portion of the front panels there is provided two auxiliary compartments 50 and 52 which can be utilized to hold any type of supplies or paraphernalia that would typically be needed or used by a military medic.

Disposed above the compartments 50 and 52 are a series of upper auxiliary compartments 54, 56, 58 and 60. Again, these compartments can be utilized to hold and support a wide variety of supplies and paraphernalia including eye kits, ammunition, etc.

Also formed about the upper shoulder portion of one front panel is a strobe light compartment indicated by the numeral 62. In addition, there can be any number of other types of compartments or retaining device formed on the vest 10 such as a flashlight holder 64, a D-ring 66, and a tape holder 68. For the most part, these compartments and retaining devices have been strategically and logically placed about the military medical vest 10 for convenience and efficiency. While a great deal of time and effort has been placed into the strategic placement of these compartments and retaining devices, it will be appreciated by those skilled in the art that at least some of the compartments and retaining devices can be rearranged while at the same time there may be a need for other types of compartments or retaining devices that would be strategically placed on the vest.

From the foregoing specification and discussion, it is appreciated that the military medical vest 10 of the present invention meets a specific need, that need being a very practical vest for a military medic to carry medical supplies and paraphernalia. In this regard, vest 10 of the present invention can be sized so as to fit a wide range of individuals and can be particularly sized so as to fit over flak jackets and other under garment protectors such as bullet proof vests.

Also, while the vest 10 of the present invention has been described as a military medical vest, it is appreciated that the vest can be utilized in a wide range of medical applications.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A military medical vest for holding an array of medical supplies such as IV bags, etc., comprising:

a) a vest having a back panel having a vertically disposed central axis, a pair of side panels, and a pair of divided front panels;

b) a series of transversely extending vertically spaced IV bag holders secured to the back panel, the series of IV bag holders including a plurality of transversely extending and vertically spaced elongated compartments with each compartment having opposed open ends with a closure flap secured adjacent to the open end and operative to close the compartments;

at least two side-by-side field dressing compartments disposed on the back panel and above the series of IV bag holders, each of the side-by-side field dressing compartments including an inner disposed closed end adjacent said central axis and an outer open end facing away from said central axis and where there is a closure flap mounted adjacent each open end of the respective field dressing compartments; and a series of chest tube holders located on the back panel and above said field dressing compartments comprised of at least one pair of loops spaced laterally of said central axis such that a chest tube can be supported in said spaced loops in a substantially perpendicularly disposed position with respect to said central axis so as to leave the arms of a wearer of the vest unimpaired when a chest tube is carried by the chest tube holder.

2. The military medical vest of claim 1 further including a strobe light holder located on a front panel of the vest.

3. The military medical vest of claim 2 further including a tape holder located on the front panel of the vest, the tape holder including a loop insertable through a roll of tape for securing the tape roll to the front panel of the vest.

4. The military medical vest of claim 3 further including a D-ring holder located on a front panel of the military vest, the D-ring holder including a loop insertable through the D-ring holder for securing the D-ring holder on the front panel.

5. The military medical vest of claim 4 further including a flashlight holder, the flashlight holder including a plurality of loops for engaging and securing a flashlight to the vest.

6. The military medical vest of claim 5 further including an IV catheter holder located on the side panel of the vest.

7. The military medical vest of claim 6 further including a holster located on a side panel for securing a side arm to the vest.

* * * * *